US010014007B2

(12) United States Patent
Dachiraju et al.

(10) Patent No.: US 10,014,007 B2
(45) Date of Patent: Jul. 3, 2018

(54) METHOD FOR FORMING THE EXCITATION SIGNAL FOR A GLOTTAL PULSE MODEL BASED PARAMETRIC SPEECH SYNTHESIS SYSTEM

(71) Applicant: Interactive Intelligence, Inc., Indianapolis, IN (US)

(72) Inventors: Rajesh Dachiraju, Hyderabad (IN); Aravind Ganapathiraju, Hyderabad (IN)

( * ) Notice: Subject to any disclaimer, the term of this patent is extended or adjusted under 35 U.S.C. 154(b) by 0 days.

(21) Appl. No.: 14/288,745

(22) Filed: May 28, 2014

(65) Prior Publication Data

US 2015/0348535 A1 Dec. 3, 2015

(51) Int. Cl.
*G10L 25/90* (2013.01)
*G10L 13/02* (2013.01)

(52) U.S. Cl.
CPC ..... *G10L 25/90* (2013.01); *G10L 13/02* (2013.01)

(58) Field of Classification Search
CPC ..... G10L 15/04; G10L 15/05; G10L 15/06; G10L 21/0208; G10L 2021/02168
USPC ..... 704/7, 10, 201, 208, 210, 215, 224, 234, 704/248
See application file for complete search history.

(56) References Cited

U.S. PATENT DOCUMENTS 5,377,301 A 12/1994 Rosenberg et al.
5,400,434 A * 3/1995 Pearson ..... G10L 13/06 704/264
5,937,384 A 8/1999 Huang et al.
5,953,700 A 9/1999 Kanevsky et al.
6,088,669 A 7/2000 Maes
6,795,807 B1 9/2004 Baraff
7,337,108 B2 * 2/2008 Florencio ..... G10L 21/04 704/208

(Continued)

FOREIGN PATENT DOCUMENTS

EP 2242045 6/2012
JP 2002244689 A 8/2002

(Continued)

OTHER PUBLICATIONS

Srinivas et al., "An FIR Implementation of Zero Frequency Filtering of Speech Signals," IEEE Transactions on Audio, Speech, and Language Processing, vol. 20, No. 9, Nov. 2012.*

(Continued)

*Primary Examiner* — Paras D Shah
*Assistant Examiner* — Rodrigo Chavez

(57) ABSTRACT

A method is presented for forming the excitation signal for a glottal pulse model based parametric speech synthesis system. In one embodiment, fundamental frequency values are used to form the excitation signal. The excitation is modeled using a voice source pulse selected from a database of a given speaker. The voice source signal is segmented into glottal segments, which are used in vector representation to identify the glottal pulse used for formation of the excitation signal. Use of a novel distance metric and preserving the original signals extracted from the speakers voice samples helps capture low frequency information of the excitation signal. In addition, segment edge artifacts are removed by applying a unique segment joining method to improve the quality of synthetic speech while creating a true representation of the voice quality of a speaker.

35 Claims, 8 Drawing Sheets

(56) References Cited

U.S. PATENT DOCUMENTS

| | | | | |
|---|---|---|---|---|
| 7,386,448 | B1 | 6/2008 | Poss et al. | |
| 8,386,256 | B2 | 2/2013 | Raitio et al. | |
| 8,571,871 | B1 * | 10/2013 | Stuttle | G10L 13/033 704/260 |
| 2002/0116196 | A1 | 8/2002 | Tran | |
| 2002/0120450 | A1 * | 8/2002 | Junqua | G10L 13/04 704/258 |
| 2009/0024386 | A1 * | 1/2009 | Su | G10L 19/09 704/201 |
| 2009/0119096 | A1 | 5/2009 | Gerl et al. | |
| 2011/0040561 | A1 | 2/2011 | Vair et al. | |
| 2011/0161076 | A1 * | 6/2011 | Davis | G06F 3/04842 704/231 |
| 2011/0262033 | A1 * | 10/2011 | Huo | G06K 9/00422 382/161 |
| 2012/0123782 | A1 | 5/2012 | Wilfart et al. | |
| 2013/0080172 | A1 | 3/2013 | Talwar et al. | |
| 2013/0262096 | A1 | 10/2013 | Wilhelms-Tricarico et al. | |
| 2014/0142946 | A1 | 5/2014 | Chen | |
| 2014/0156280 | A1 | 6/2014 | Ranniery | |
| 2014/0222428 | A1 | 8/2014 | Cumani et al. | |
| 2015/0100308 | A1 * | 4/2015 | Bedrax-Weiss | G06F 17/2735 704/10 |

FOREIGN PATENT DOCUMENTS

| | | | |
|---|---|---|---|
| JP | 2010230704 | A | 10/2010 |
| JP | 2012252488 | A | 10/2012 |
| JP | 2013182872 | A | 9/2013 |
| WO | WO 2015/183254 | A1 | 12/2015 |

OTHER PUBLICATIONS

Thakur et al., "Speech Recognition Using Euclidean Distance," Akanksha Singh Thakur, Namrata Sahayam, International Journal of Emerging Technology and Advanced Engineering Website: www.ijetae.com (ISSN 2250-2459, ISO 9001:2008 Certified Journal, vol. 3, Issue 3, Mar. 2013).*

International Search Report and Written Opinion of the International Searching Authority, dated Jan. 8, 2016 in related PCT application PCT/US15/54122 (Interational Filing Date Oct. 6, 2015).

International Search Report and Written Opinion of the International Searching Authority dated Apr. 6, 2015 in related foreign application PCT/US 14/39722 (International filing date May 28, 2014).

Cabral, J., et al.; Glottal Spectral Separation for Speech Synthesis, IEEE Journal of Selected Topics in Signal Processing, vol. 8, No. 2, Apr. 2014, 14 pages.

Extended European Search Report for Application No. 14893138,9, dated Jan. 3, 2018, 16 pages.

Gabor, T., et al., A novel codebook-based excitation model for use in speech synthesis, CoginfoCom 2012, 3rd IEEE International Conference on Cognitive Infocommunications, Dec. 2-5, 2012, 5 pages.

Prathosh, A.P., et al.; Epoch Extraction Based on Integrated Linear Prediction Residual Using Plosion Index, IEEE Transactions on Audio, Speech, and Language Processing, vol. 21, No. 12, Dec. 2013, 10 pages.

Raitio, T., et al.; Comparing Glottal-Flow-Excited Statistical Parametric Speech Synthesis Methods, Article, IEEE, 2013, 5 pages.

International Search Report and Written Opinion for International Application No. PCT/US2017/035806, dated Aug. 11, 2017 (14 sheets).

Japanese Office Action with English Translation for Application No. 2016-567717, dated Feb. 1, 2018, 12 pages.

Murty, K. Sri Rama, et al.; Epoch Extraction From Speech Signals, IEEE Trans. ASLP, EEE, Oct. 21, 2008, vol. No. 8, pp. 1602-1613.

Yoshikawa, Eiichi, et al.; A Tentative Algorithm for Estimatig the Glottal Waveform with Glottal Closure Information and English Translation, IEEE, Article (J81-A), No. 3, Mar. 25, 1998, pp. 303-311.

* cited by examiner

200

300

400

METHOD FOR FORMING THE EXCITATION SIGNAL FOR A GLOTTAL PULSE MODEL BASED PARAMETRIC SPEECH SYNTHESIS SYSTEM

BACKGROUND

The present invention generally relates to telecommunications systems and methods, as well as speech synthesis. More particularly, the present invention pertains to the formation of the excitation signal in a Hidden Markov Model based statistical parametric speech synthesis system.

SUMMARY

A method is presented for forming the excitation signal for a glottal pulse model based parametric speech synthesis system. In one embodiment, fundamental frequency values are used to form the excitation signal. The excitation is modeled using a voice source pulse selected from a database of a given speaker. The voice source signal is segmented into glottal segments, which are used in vector representation to identify the glottal pulse used for formation of the excitation signal. Use of a novel distance metric and preserving the original signals extracted from the speakers voice samples helps capture low frequency information of the excitation signal. In addition, segment edge artifacts are removed by applying a unique segment joining method to improve the quality of synthetic speech while creating a true representation of the voice quality of a speaker.

In one embodiment, a method is presented to create a glottal pulse database from a speech signal, comprising the steps of: performing pre-filtering on the speech signal to obtain a pre-filtered signal; analyzing the pre-filtered signal to obtain inverse filtering parameters; performing inverse filtering of the speech signal using the inverse filtering parameters; computing an integrated linear prediction residual signal using the inversely filtered speech signal; identifying glottal segment boundaries in the speech signal; segmenting the integrated linear prediction residual signal into glottal pulses using the identified glottal segment boundaries from the speech signal; performing normalization of the glottal pulses; and forming the glottal pulse database by collecting all normalized glottal pulses obtained for the speech signal.

In another embodiment, a method is presented to form parametric models, comprising the steps of: computing a glottal pulse distance metric between a number of glottal pulses; clustering the glottal pulse database into a number of clusters to determine centroid glottal pulses; forming a corresponding vector database by associating a vector with each glottal pulse in the glottal pulse database, wherein the centroid glottal pulses and the distance metric is defined mathematically to determine association; determining Eigenvectors of the vector database; and forming parametric models by associating a glottal pulse from the glottal pulse database to each determined Eigenvector.

In yet another embodiment, a method is presented to synthesize speech using input text, comprising the steps of: a) converting the input text into context dependent phone labels; b) processing the phone labels created in step (a) using trained parametric models to predict fundamental frequency values, duration of the speech synthesized, and spectral features of the phone labels; c) creating an excitation signal using an Eigen glottal pulse and said predicted one or more of: fundamental frequency values, spectral features of phone labels, and duration of the speech synthesized; and d) combining the excitation signal with the spectral features of the phone labels using a filter to create synthetic speech output.

DETAILED DESCRIPTION

Figure 1:
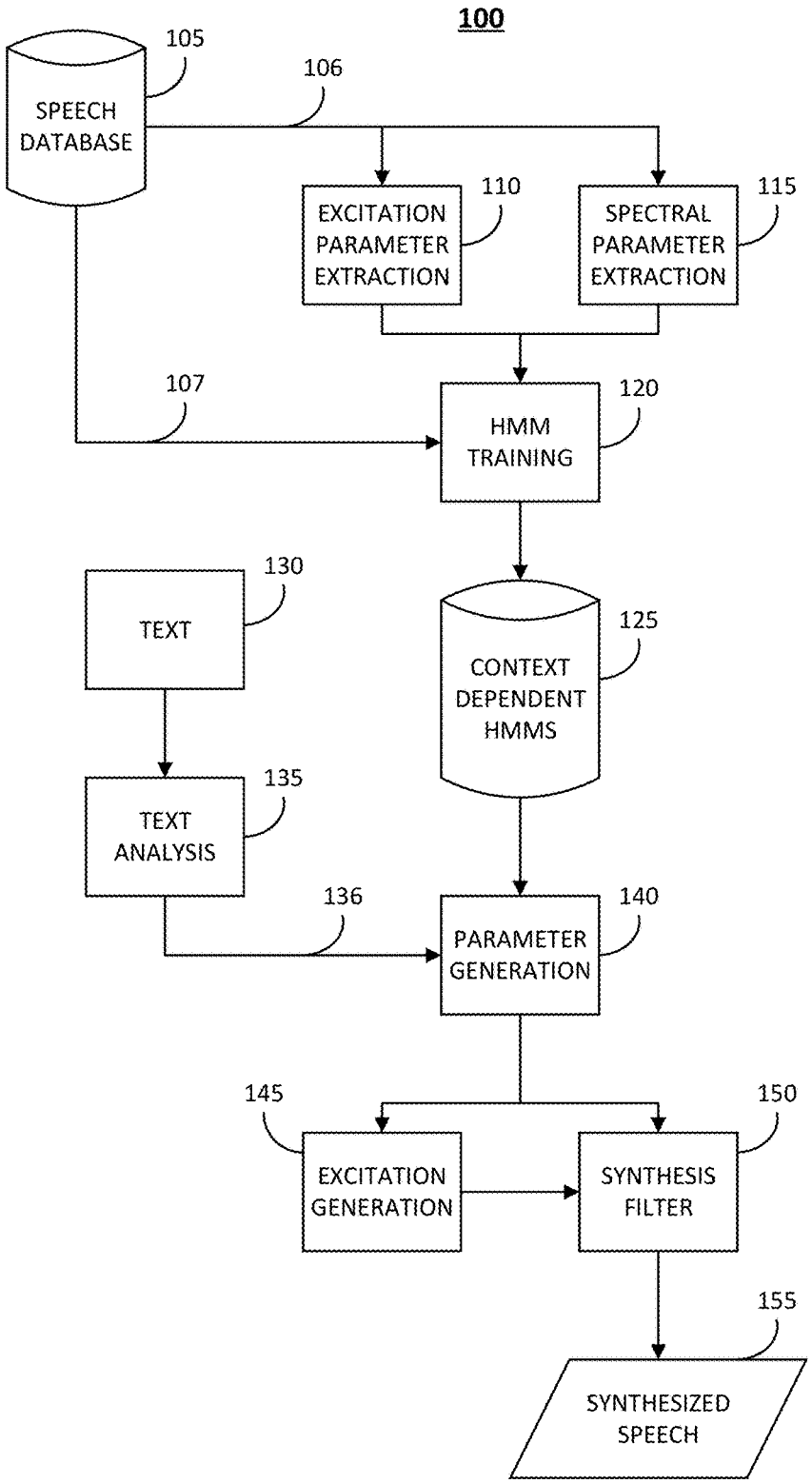
FIG. 1 is a diagram illustrating an embodiment of an Hidden Markov Model based Text to Speech system.

For the purposes of promoting an understanding of the principles of the invention, reference will now be made to the embodiment illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Excitation is generally assumed to be a quasi-periodic sequence of impulses for voiced regions. Each sequence is separated from the previous sequence by some duration, such as $$T_0 = \frac{1}{F_0},$$

where $T_0$ represents pitch period and $F_0$ represents fundamental frequency. The excitation, in unvoiced regions, is modeled as white noise. In voiced regions, the excitation is not actually impulse sequences. The excitation is instead a sequence of voice source pulses which occur due to vibration of the vocal folds. The pulses' shapes may vary depending on various factors such as the speaker, the mood of the speaker, the linguistic context, emotions, etc.

Source pulses have been treated mathematically as vectors by length normalization (through resampling) and impulse alignment, as described in European Patent EP 2242045 (granted Jun. 27, 2012, inventors Thomas Drugman, et al.) The final length of normalized source pulse signal is resampled to meet the target pitch. The source pulse is not chosen from a database, but obtained over a series of calculations which compromise the pulse characteristics in the frequency domain. In addition, the approximate excitation signal used for creating a pulse database does not capture low frequency source content as there is no pre-filtering done while determining the Linear Prediction (LP) coefficients, which are used for inverse filtering.

In statistical parametric speech synthesis, speech unit signals are represented by a set of parameters which can be used to synthesize speech. The parameters may be learned by statistical models, such as HMMs, for example. In an embodiment, speech may be represented as a source-filter model, wherein source/excitation is a signal which when passed through an appropriate filter produces a given sound. FIG. 1 is a diagram illustrating an embodiment of a Hidden Markov Model (HMM) based Text to Speech (TTS) system. An embodiment of an exemplary system may contain two phases, for example, the training phase and the synthesis phase.

The Speech Database 105 may contain an amount of speech data for use in speech synthesis. During the training phase, a speech signal 106 is converted into parameters. The parameters may be comprised of excitation parameters and spectral parameters. Excitation Parameter Extraction 110 and Spectral Parameter Extraction 115 occurs from the speech signal 106 which travels from the Speech Database 105. A Hidden Markov Model 120 may be trained using these extracted parameters and the Labels 107 from the Speech Database 105. Any number of HMM models may result from the training and these context dependent HMMs are stored in a database 125.

The synthesis phase begins as the context dependent HMMs 125 are used to generate parameters 140. The parameter generation 140 may utilize input from a corpus of text 130 from which speech is to be synthesized from. The text 130 may undergo analysis 135 and the extracted labels 136 are used in the generation of parameters 140. In one embodiment, excitation and spectral parameters may be generated in 140.

The excitation parameters may be used to generate the excitation signal 145, which is input, along with the spectral parameters, into a synthesis filter 150. Filter parameters are generally Mel frequency cepstral coefficients (MFCC) and are often modeled by a statistical time series by using HMMs. The predicted values of the filter and the fundamental frequency as time series values may be used to synthesize the filter by creating an excitation signal from the fundamental frequency values and the MFCC values used to form the filter.

Synthesized speech 155 is produced when the excitation signal passes through the filter. The formation of the excitation signal 145 is integral to the quality of the output, or synthesized, speech 155. Low frequency information of the excitation is not captured. It will thus be appreciated that an approach is needed to capture the low frequency source content of the excitation signal and to improve the quality of synthetic speech.

Figure 2:
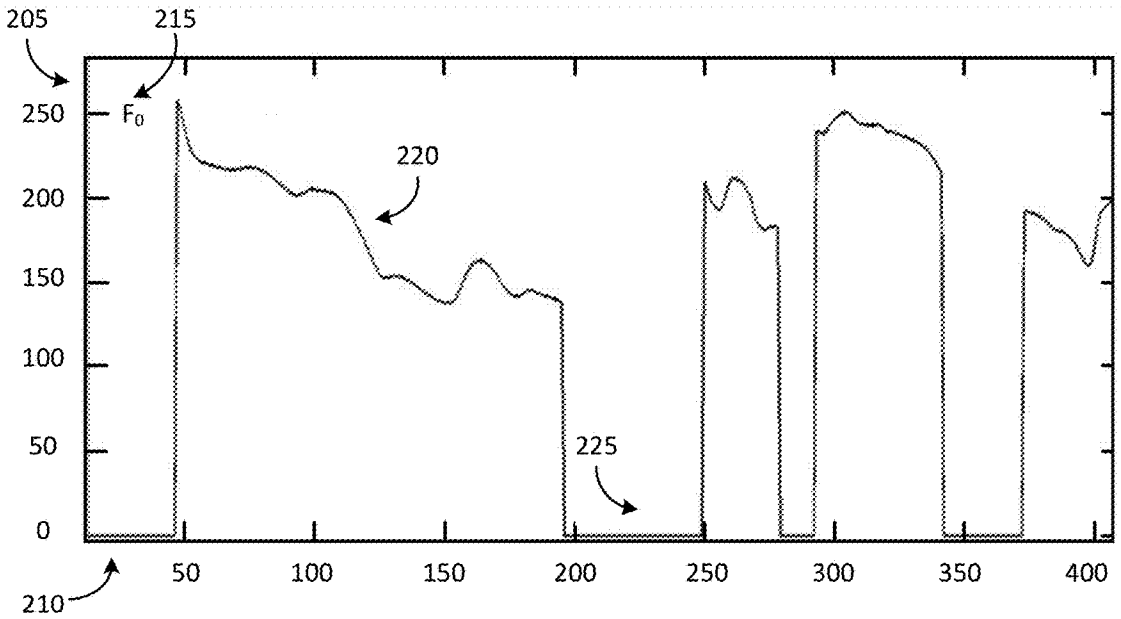
FIG. 2 is a diagram illustrating an embodiment of a signal.

FIG. 2 is a graphical illustration of an embodiment of the signal regions of a speech segment, indicated generally at 200. The signal has been broken down into segments based on fundamental frequency values for categories such as voiced, unvoiced, and pause segments. The vertical axis 205 illustrates fundamental frequency in Hertz (Hz) while the horizontal axis 210 represents the passage of milliseconds (ms). The time series, $F_0$, 215 represents the fundamental frequency. The voiced region, 220 can be seen as a series of peaks and may be referred to as a non-zero segment. The non-zero segments 220 may be concatenated to form an excitation signal for the entire speech, as described in further detail below. The unvoiced region 225 is seen as having no peaks in the graphical illustration 200 and may be referred to as zero segments. The zero segments may represent a pause or an unvoiced segment given by the phone labels.

Figure 3:
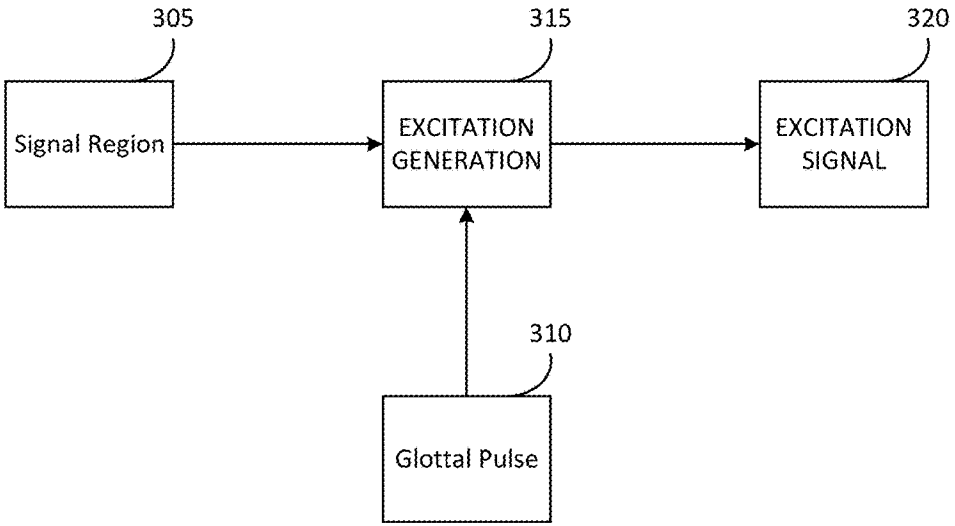
FIG. 3 is a diagram illustrating an embodiment of excitation signal creation.

FIG. 3 is a diagram illustrating an embodiment of excitation signal creation indicated generally at 300. FIG. 3 illustrates the creation of the excitation signal for both unvoiced and pause segments. The fundamental frequency time series values, represented as $F_0$, represent signal regions 305 that are broken down into voiced, unvoiced, and pause segments based on the $F_0$ values.

An excitation signal 320 is created for unvoiced and pause segments. Where pauses occur, zeros (0) are placed in the excitation signal. In unvoiced regions, white noise of appropriate energy (in one embodiment, this may be determined empirically by listening tests) is used as the excitation signal.

The signal regions, 305, along with the Glottal Pulse 310 are used for excitation generation 315 and subsequent generation of the excitation signal 320. The Glottal Pulse 310 comprises an Eigen glottal pulse that has been identified from the glottal pulse database, the creation of which is described in further detail in FIG. 8 below.

Figure 4:
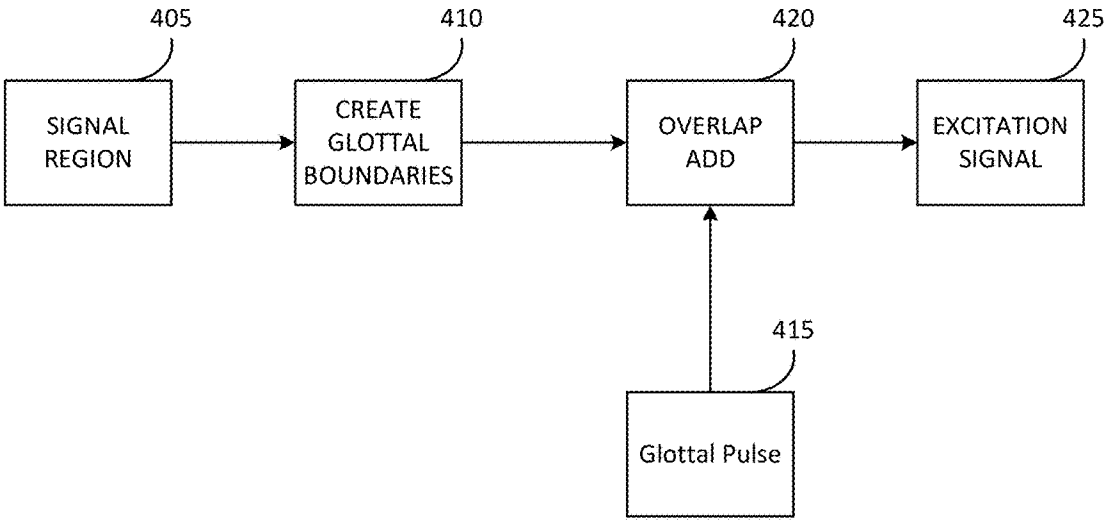
FIG. 4 is a diagram illustrating an embodiment of excitation signal creation.

FIG. 4 is a diagram illustrating an embodiment of excitation signal creation for a voiced segment, indicated generally at 400. It is assumed that a Eigen glottal pulse has been identified from the glottal pulse database (described in further detail in FIG. 7 below). The signal region 405 comprises $F_0$ values, which may be predicted by models, from the voiced segment. The lengths of the $F_0$ segments, which may be represented by $N_f$, are used to determine the length of the excitation signal using the mathematical equation:

$$F_0(n)=f_s*N_f*5/1000.$$

Where $f_s$ represents the sampling frequency of the signal. In a non-limiting example, the value of 5/1000 represents the interval of 5 ms durations that the $F_0$ values are determined for. It should be noted that any interval of a designated duration of a unit time may be used. Another array, designated as $F'_0(n)$, is obtained by linearly interpolating the $F_0$ array.

From the $F_0$ values, glottal boundaries are created, 410, which mark the pitch boundaries of the excitation signal of the voiced segments in the signal region 405. The pitch period array may be computed using the following mathematical equation:

$$T_0(n) = \frac{f_s}{F'_0(n)}$$

Pitch boundaries may then be computed using the determined pitch period array as follows:

$$P^0(i)=\Sigma_{j=0}^{i}T_0(P^0(i-1)$$

Where $P^0(0)=1$, i=1, 2, 3, . . . K, and where P(K+1) just crosses length of the array $T_0(n)$.

The glottal pulse 415 is used along with the identified glottal boundaries 410 in the overlap adding 420 of a glottal pulse beginning at each glottal boundary. The excitation signal 425 is then created through the process of "stitching", or segment joining, to avoid boundary effects which are further described in FIGS. 5 and 6.

Figure 5:
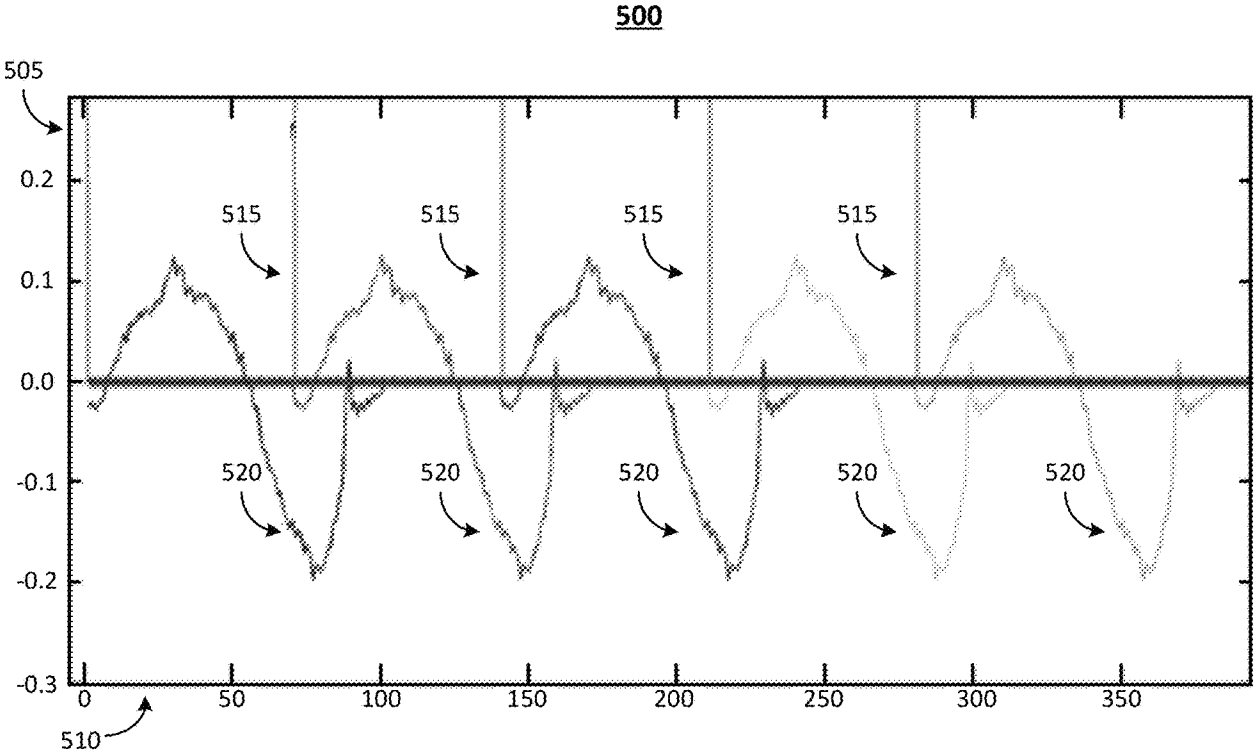
FIG. 5 is a diagram illustrating an embodiment of overlap boundaries.

FIG. 5 is a diagram illustrating an embodiment of overlap boundaries, indicated generally at 500. The illustration 500 represents a series of glottal pulses 515 and overlapping glottal pulses 520 in the segment. The vertical axis 505 represents the amplitude of excitation. The horizontal axis 510 may represent the frame number.

Figure 6:
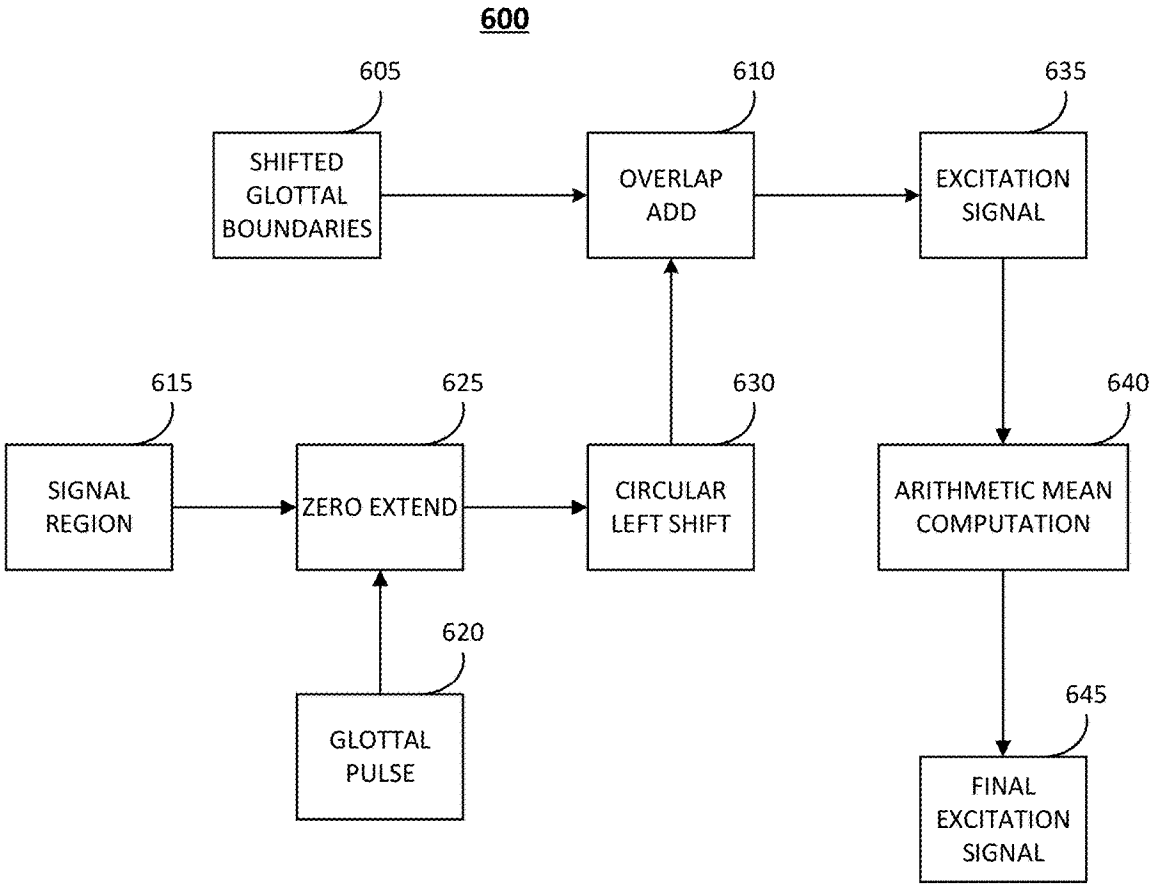
FIG. 6 is a diagram illustrating an embodiment of excitation signal creation.

FIG. 6 is a diagram illustrating an embodiment of excitation signal creation for a voiced segment, indicated generally at 600. "Stitching" may be used to form the final excitation signal of voiced segments (from FIG. 4), which is ideally devoid of boundary effects. In an embodiment, any number of different excitation signals may have been formed through the overlap add method illustrated in FIG. 4 and in the diagram 500 (FIG. 5). The different excitation signals may have a constantly increasing amount of shifts in glottal boundaries 605 and an equal amount of circular left shift 630 for the glottal pulse signal. In one embodiment, if the glottal pulse signal 615 is of a length less than the corresponding pitch period, then the glottal pulse may be zero extended 625 to the length of the pitch period before circular left shifting 630 is performed. Different arrays of pitch boundaries (represented as $P^m(i)$, m=1, 2, . . . M−1) are formed with each of the same length as $P^0$. The arrays are computed using the following mathematical equation:

$$P^m(i)=P^0(i)+m*w$$

Where w is generally taken as 1 msec or, in terms of samples, $$\frac{f_s}{1000}.$$

For a sampling frequency of $f_s$=16,000, w=16, for example. The highest pitch period present in the given voice segment is represented as m*w. Glottal pulses are created and associated with each pitch boundary array $P^m$. The glottal pulses 620 may be obtained from the glottal pulse signal of some length N by first zero extending it to the pitch period and then circularly left shifting it by m*w samples.

For each set of frame boundaries, an excitation signal 635 is formed by initializing the glottal pulses to zero (0). Overlap add 610 is used to add the glottal pulse 620 to the first N samples of the excitation, starting from each pitch boundary value of the array $P^m(i)$, i=1, 2, . . . K. The formed signal is as a single stitched excitation, corresponding to the shift, m.

In an embodiment, the arithmetic mean of all of the single stitched excitation signals is then computed 640, which represents the final excitation signal for the voiced segment 645.

Figure 7:
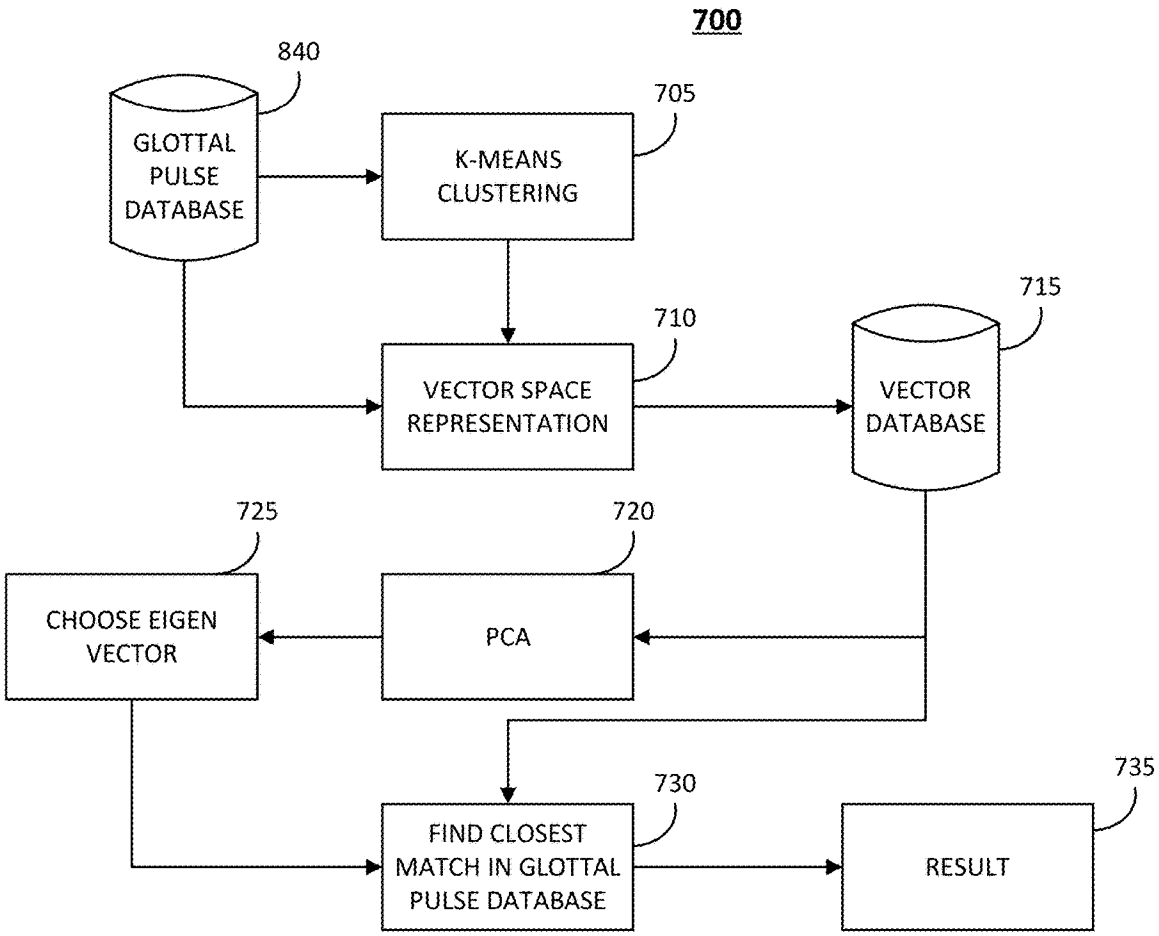
FIG. 7 is a diagram illustrating an embodiment of glottal pulse identification.

FIG. 7 is a diagram illustrating an embodiment of glottal pulse identification, indicated generally at 700. In an embodiment, any two given glottal pulses may be used to compute the distance metric/dissimilarity between them. These are taken from the glottal pulse database 840 created in process 800 (further described in FIG. 8 below). The computation may be performed by decomposing the two given glottal pulses $x_i$, $y_i$ into sub-band components $x_i^{(1)}$, $x_i^{(2)}$, $x_i^{(3)}$ and $y_i^{(1)}$, $y_i^{(2)}$, $y_i^{(3)}$. The given glottal pulse may be transformed into the frequency domain by using a method such as Discrete Cosine Transform (DCT), for example. The frequency band may be split into a number of bands, which are demodulated and converted into time domain. In this example, three bands are used for illustrative purposes.

The sub-band distance metric is then computed between corresponding sub-band components of each glottal pulses, denoted as $d_s(x_i^{(1)}, y_i^{(1)})$. The sub-band metric, which may be represented as $d_s(f, g)$, where $d_s$ represents the distance between the two sub-band components f and g, may be computed as described in the following paragraphs.

The normalized circular cross correlation function between f and g is computed. In one embodiment, this may be denoted as $R_{f,g}(n)=f\bigstar g$, where '★' denotes normalized circular cross correlation operation between two signals. The period for circular cross correlation is taken to be the highest of lengths of the two signals f and g. The shorter signal is zero extended. The Discrete Hilbert Transform of normalized circular cross correlation is computed and denoted as $R_{f,g}^h(n)$. Using the normalized circular cross correlation and the Discrete Hilbert Transform of the normalized circular cross correlation, the signal may be determined as:

$$H_{f,g}(n)=\sqrt{R_{f,g}(n)^2+R_{f,g}^h(n)^2}.$$

The cosine of the angle between the two signals f and g may be determined using the mathematical equation:

$$\cos\theta(f,g)=\text{maximum value of the signal } H_{f,g}(n) \text{ over all } n.$$

The sub-band metric, $d_s(f, g)$, between the two sub-band components f and g may be determined as:

$$d_s(f,g)=\sqrt{2(1-\cos\theta(f,g))}.$$

The distance metric between the glottal pulses is finally determined mathematically as:

$$d(x_i, y_i) = \sqrt{d_s^2(x_i^{(1)}, y_i^{(1)}) + d_s^2(x_i^{(2)}, y_i^{(2)}) + d_s^2(x_i^{(3)}, y_i^{(3)})}$$

The glottal pulse database 840 may be clustered into a number of clusters, for example 256 (or M), using a modified k-means algorithm 705. Instead of using the Euclidean distance metric, the distance metric defined above is used. The centroids of a cluster are then updated with that element of the cluster whose sum of squares of distances from all other elements of that cluster is minimum such that:

$$D_m=\Sigma_{i=1}^N d^2(g_i,g_m) \text{ is minimum for } m=c, \text{ the cluster centroid.}$$

In an embodiment, the clustering iterations are terminated when there is no shift in any of the centroids of the k clusters.

A vector, a set of N real numbers, for example 256, is associated with every glottal pulse 710 in the glottal pulse database 840 to form a corresponding vector database 715. In one embodiment, the associating is performed for a given glottal pulse $x_i$, a vector $V_i=[\psi_1(x_i), \psi_2(x_i), \psi_3(x_i), \ldots \psi_j(x_i)]$, where $\psi_j(x_i)=d^2(x_i, c_j)-d^2(x_i, x_0)-d^2(c_j, x_0)$ and, $x_0$ is a fixed glottal pulse picked from the database and $d^2(x_i, c_j)$ represents the square of the distance metric defined above between two glottal pulses $x_i$ and $c_j$ and assuming that $c_1$, $c_2$, . . . $c_i$, . . . $c_{256}$ are the centroid glottal pulses determined by clustering.

Thus, the vector associated with the given glottal pulse $x_i$ may be computed with the mathematical equation:

$$V_i=[\psi_1(x_i),\psi_2(x_i),\psi_3(x_i), \ldots \psi_j(x_i), \ldots \psi_{256}(x_i)]$$

In step 720, Principal Component Analysis (PCA) is performed to compute Eigenvectors of the vector database 715. In one embodiment, any one Eigenvector may be chosen 725. The closest matching vector 730 to the chosen Eigenvector from the vector database 715 is then determined in the sense of Euclidean distance. The glottal pulse from the pulse database 840 which corresponds to the closest matching vector 730 is regarded as the resulting Eigen glottal pulse 735 associated with an Eigenvector.

Figure 8:
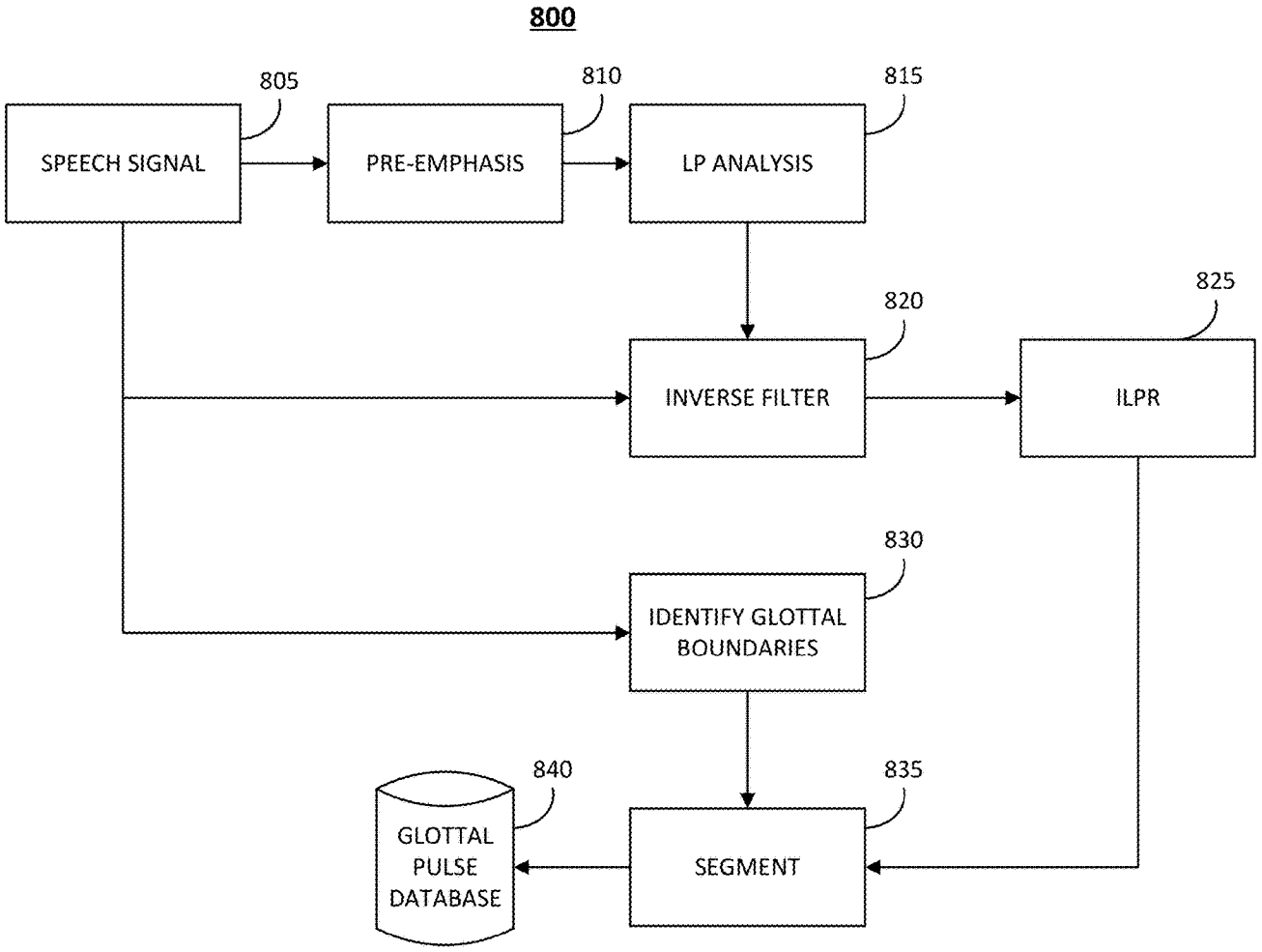
FIG. 8 is a diagram illustrating an embodiment of glottal pulse database creation.

FIG. 8 is a diagram illustrating an embodiment of glottal pulse database creation indicated generally at 800. A speech signal, 805, undergoes pre-filtering, such as pre-emphasis 810. Linear Prediction (LP) Analysis, 815, is performed using the pre-filtered signal to obtain the LP coefficients. Thus, low frequency information of the excitation may be captured. Once the coefficients are determined, they are used to inverse filter, 820, the original speech signal, 805, which is not pre-filtered, to compute the Integrated Linear Prediction Residual (ILPR) signal 825. The ILPR signal 825 may be used as an approximation to the excitation signal, or voice source signal. The ILPR signal 825 is segmented 835 into glottal pulses using the glottal segment/cycle boundaries that have been determined from the speech signal 805. The segmentation 835 may be performed using the Zero Frequency Filtering Technique (ZFF) technique. The resulting glottal pulses may then be energy normalized. All of the glottal pulses for the entire speech training data are combined in order to form the glottal pulse database 840.

While the invention has been illustrated and described in detail in the drawings and foregoing description, the same is to be considered as illustrative and not restrictive in character, it being understood that only the preferred embodiment has been shown and described and that all equivalents, changes, and modifications that come within the spirit of the invention as described herein and/or by the following claims are desired to be protected.

Hence, the proper scope of the present invention should be determined only by the broadest interpretation of the appended claims so as to encompass all such modifications as well as all relationships equivalent to those illustrated in the drawings and described in the specification.

The invention claimed is:

1. A method performed by a generic computer processor for creating a glottal pulse database from a speech signal, in a speech synthesis system, wherein the system comprises at least a speech database, the method comprising the steps of:

a. pre-emphasizing the speech signal to obtain a pre-filtered signal;

b. analyzing the pre-filtered signal, using linear prediction, to obtain inverse filtering parameters;

c. performing inverse filtering of the speech signal using the inverse filtering parameters;

d. determining an integrated linear prediction residual signal using the inversely filtered speech signal;

e. identifying glottal segment boundaries in the speech signal;

f. segmenting the integrated linear prediction residual signal into glottal pulses using the identified glottal segment boundaries from the speech signal;

g. normalizing the glottal pulses;

h. forming the glottal pulse database by collecting all normalized glottal pulses obtained for the speech signal; and i. applying the formed glottal pulse database to form an excitation signal, wherein the excitation signal is applied in the speech synthesis system to synthesize speech.

2. The method of claim 1, wherein the inverse filtering parameters in step (b) comprise linear prediction coefficients.

3. The method of claim 1, wherein the identifying of step (e) is performed using Zero Frequency Filtering technique.

4. A method for creating parametric models for use in training a speech synthesis system performed by a generic computer processor, wherein the system comprises at least a glottal pulse database, the method comprising the steps of:

a. determining a glottal pulse distance metric between a number of glottal pulses;

b. clustering the glottal pulse database into a number of clusters to determine centroid glottal pulses;

c. forming a corresponding vector database by associating a vector with each glottal pulse in the glottal pulse database, wherein the centroid glottal pulses and the distance metric are defined mathematically to determine association;

d. determining Eigenvectors of the vector database;

e. creating parametric models by associating a glottal pulse from the glottal pulse database to each determined Eigenvector; and f. applying the created parametric models to the speech synthesis system in order to train the speech synthesis system.

5. The method of claim 4, wherein the number of glottal pulses is two.

6. The method of claim 4, wherein step (a) further comprises the steps of:

a. de-composing the number of glottal pulses into corresponding sub-band components;

b. computing a sub-band distance metric between the corresponding sub-band components of each glottal pulse; and c. computing the glottal pulse distance metric mathematically using the sub-band distance metrics.

7. The method of claim 6, wherein the computing of step (c) is performed using the mathematical equation:

$$d(x_i, y_i) = \sqrt{d_s^2(x_i^{(1)}, y_i^{(1)}) + d_s^2(x_i^{(2)}, y_i^{(2)}) + d_s^2(x_i^{(3)}, y_i^{(3)})}$$

Where $d(x_i, y_i)$ represents the distance metric and $d_s^2(x_i^{(n)}, y_i^{(n)})$ represents the sub-band distance metrics.

8. The method of claim 4, wherein the number of clusters is 256.

9. The method of claim 4, wherein the clustering of step (b) is performed using a modified k-means calculation that utilizes the glottal pulse distance metric.

10. The method of claim 9, wherein the modified k-means calculation further comprises updating a centroid of a cluster with an element of the cluster whose sum of squares of distances from all other elements of that cluster is minimum.

11. The method of claim 10, further comprising terminating the clustering iterations when there is no shift in any of the centroids from the clusters.

12. The method of claim 4, wherein the determining of Eigenvectors of step (d) is performed using Principal Component Analysis.

13. The method of claim 4, wherein step (e) further comprises the steps of:

a. determining the Eigenvector;

b. determining the closest matching vector from the vector database to the Eigenvector c. determining the closest matching glottal pulse from the glottal pulse database; and d. naming the glottal pulse from the glottal pulse database that is the closest match to the Eigenvector as the Eigen glottal pulse associated with the Eigenvector.

14. The method of claim 4, wherein the training further comprises the steps of:

a. defining a training text corpus;

b. obtaining speech data by recording a voice talent speaking the training text;

c. converting the training text into context dependent phone labels;

d. determining the spectral features of the speech data using the phone labels;

e. estimating fundamental frequency of the speech data; and f. performing parameter estimation on an audio stream using the spectral features, the fundamental frequency, and the duration of the audio stream.

15. A method to synthesize speech performed by a generic computer processor using input text, comprising the steps of:

a. converting the input text into context dependent phone labels;

b. processing the phone labels created in step (a) using trained parametric models to predict fundamental frequency values, duration of the speech synthesized, and spectral features of the phone labels;

c. creating an excitation signal using an Eigen glottal pulse and said predicted one or more of: fundamental frequency values, spectral features of phone labels, and duration of the speech synthesized;

d. dividing signal regions of excitation into categories of segments comprising one or more of: voiced, unvoiced, and/or pause;

e. creating an excitation for each category;

f. combining the excitation signal with the spectral features of the phone labels using a filter to create synthetic speech output.

16. The method of claim 15, wherein the dividing is performed based on the fundamental frequency value.

17. The method of claim 15, wherein the filter of step (d) comprises a Mel Log Spectrum Approximation filter.

18. The method of claim 15, wherein the step of creating an excitation signal comprises placing white noise in the unvoiced segments.

19. The method of claim 15, wherein the step of creating an excitation signal for pause segments comprises placing a zero in the segment.

20. The method of claim 15, wherein the excitation signal is created for voiced segments comprising the steps of:

a. creating glottal boundaries, using the predicted fundamental frequency value from a model, wherein the glottal boundaries mark pitch boundaries of the excitation signal;

b. adding a glottal pulse beginning at each glottal boundary using an overlap add method;

c. avoiding boundary effects in the excitation signal wherein the avoiding further comprises the steps of:

i. creating a number of different excitations formed through the overlap add method with a constantly increasing amount of shifts in the glottal boundaries and an equal amount of circular left shift for the glottal pulse, wherein if the glottal pulse is of a length less than the corresponding pitch period, then the glottal pulse is zero extended to the length of pitch period prior to the left shift, ii. determining the arithmetic mean of the number of different excitation signals, and iii. declaring the arithmetic mean the final excitation signal for the voiced segment.

21. The method of claim 15, wherein the Eigen glottal pulse is identified from a glottal pulse database, the identification comprising the steps of:

a. computing a glottal pulse distance metric between a number of glottal pulses;

b. clustering the glottal pulse database into a number of clusters to determine centroid glottal pulses;

c. forming a corresponding vector database by associating a vector with each glottal pulse in the glottal pulse database, wherein the centroid glottal pulses and the distance metric is defined mathematically to determine association;

d. determining Eigenvectors of the vector database; and e. forming parametric models by associating a glottal pulse from the glottal pulse database to each determined Eigenvector to form parametric models.

22. The method of claim 21, wherein the number of glottal pulses is two.

23. The method of claim 21, wherein step (a) further comprises the steps of:

a. de-composing the number of glottal pulses into corresponding sub-band components;

b. computing a sub-band distance metric between the corresponding sub-band components of each glottal pulse; and c. computing the distance metric mathematically using the sub-band distance metrics.

24. The method of claim 23, wherein the computing of step (c) is performed using the mathematical equation:

$$d(x_i, y_i) = \sqrt{d_s^2(x_i^{(1)}, y_i^{(1)}) + d_s^2(x_i^{(2)}, y_i^{(2)}) + d_s^2(x_i^{(3)}, y_i^{(3)})}$$

Where $d(x_i, y_i)$ represents the distance metric and $d_s^2(x_i^{(n)}, y_i^{(n)})$ represents the sub-band distance metrics.

25. The method of claim 21, wherein the number of clusters is 256.

26. The method of claim 21, wherein the clustering of step (b) is performed using a modified k-means calculation that utilizes the glottal pulse distance metric.

27. The method of claim 26, wherein the modified k-means calculation further comprises updating a centroid of a cluster with an element of the cluster whose sum of squares of distances from all other elements of that cluster is minimum.

28. The method of claim 27, further comprising terminating the clustering iterations when there is no shift in any of the centroids from the clusters.

29. The method of claim 21, wherein the determining of Eigenvectors of step (d) is performed using Principal Component Analysis.

30. The method of claim 21, wherein step (e) further comprises the steps of:

a. determining the Eigenvector;

b. determining the closest matching vector from the vector database to the Eigenvector;

c. determining the closest matching glottal pulse from the glottal pulse database; and d. naming the glottal pulse from the glottal pulse database that is the closest match to the Eigenvector as the Eigen glottal pulse associated with the Eigenvector.

31. The method of claim 21, further comprising building the glottal pulse database from a speech signal, the building comprising the steps of:

a. performing pre-filtering of the speech signal to obtain a pre-filtered signal;

b. analyzing the pre-filtered signal to obtain inverse filtering parameters;

c. performing inverse filtering of the speech signal using the inverse filtering parameters;

d. computing an integrated linear prediction residual signal using the inversely filtered speech signal;

e. identifying glottal segment boundaries in the speech signal;

f. segmenting the integrated linear prediction residual signal into glottal pulses using the identified glottal segment boundaries from the speech signal;

g. performing normalization of the glottal pulses; and h. forming the glottal pulse database by collecting all normalized glottal pulses obtained for the speech signal.

32. The method of claim 31, wherein the analysis of step (b) is performed using linear prediction.

33. The method of claim 31, wherein the inverse filtering parameters in step (b) comprise linear prediction coefficients.

34. The method of claim 31, wherein the identifying of step (e) is performing using Zero Frequency Filtering technique.

35. The method of claim 31, wherein the pre-filtering of step (a) comprises pre-emphasis.

* * * * *